US011558687B2

(12) United States Patent
Zhao

(10) Patent No.: US 11,558,687 B2
(45) Date of Patent: Jan. 17, 2023

(54) INTERACTIVE CONTROL METHOD AND DEVICE OF EARPHONES, EARPHONE AND STORAGE MEDIUM

(71) Applicant: GOERTEK INC., Shandong (CN)

(72) Inventor: Jifu Zhao, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 17/309,138

(22) PCT Filed: Dec. 29, 2018

(86) PCT No.: PCT/CN2018/125261
§ 371 (c)(1),
(2) Date: Apr. 29, 2021

(87) PCT Pub. No.: WO2020/087749
PCT Pub. Date: May 7, 2020

(65) Prior Publication Data

US 2022/0038807 A1 Feb. 3, 2022

(30) Foreign Application Priority Data

Oct. 29, 2018 (CN) ..... 201811271607.8
Nov. 9, 2018 (CN) ..... 201811332529.8

(51) Int. Cl.
*H04R 1/10* (2006.01)
*H04R 5/033* (2006.01)
*H04R 5/04* (2006.01)

(52) U.S. Cl.
CPC ..... *H04R 1/1041* (2013.01); *H04R 1/1091* (2013.01); *H04R 5/033* (2013.01); *H04R 5/04* (2013.01); *H04R 2420/07* (2013.01)

(58) Field of Classification Search
CPC .... H04R 1/1041; H04R 1/1091; H04R 5/033; H04R 5/04; H04R 2420/07
See application file for complete search history.

(56) References Cited

U.S. PATENT DOCUMENTS 9,325,828 B1 * 4/2016 Oh ..... H04M 1/72454
2007/0076897 A1 * 4/2007 Philipp ..... H04R 1/1041 381/74

(Continued)

FOREIGN PATENT DOCUMENTS

CN 103257873 A 8/2013
CN 104616676 A 5/2015

(Continued)

OTHER PUBLICATIONS

WIPO Translate, "CN108632703—Bluetooth Earphone Loudspeaker Box System and Loudspeaker Box", Oct. 9, 2018, Online Machine Translation of National Biblio. Data and Description, https://patentscope.wipo.int/search/en/detail.jsf?docPN=CN108632703#atapta0, pp. 1-8. (Year: 2018).*

*Primary Examiner* — Daniel R Sellers
(74) *Attorney, Agent, or Firm* — LKGlobal | Lorenz & Kopf, LLP

(57) ABSTRACT

An interactive control method and device of earphones, an earphone and a storage medium are disclosed. The earphones include a first earphone and a second earphone. The method comprises: acquiring putting-on sequential order information or taking-off sequential order information of the first earphone and/or the second earphone; determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and sending the first functional instruction or the second functional instruction to the mobile terminal, so that the mobile terminal executes the first functional instruction or the second functional instruction to realize a (Continued)

first interaction function or a second interaction function with the earphones.

17 Claims, 3 Drawing Sheets

(56) References Cited

U.S. PATENT DOCUMENTS

| | | | | |
|---|---|---|---|---|
| 2007/0223725 | A1* | 9/2007 | Neumann | H04R 5/04 381/313 |
| 2014/0016803 | A1* | 1/2014 | Puskarich | H04R 1/1041 381/74 |
| 2014/0086438 | A1 | 3/2014 | Tachibana et al. | |
| 2014/0198026 | A1 | 7/2014 | Kim et al. | |
| 2014/0314247 | A1* | 10/2014 | Zhang | H04R 1/1041 381/74 |
| 2016/0205460 | A1 | 7/2016 | Tachibana et al. | |
| 2019/0045291 | A1* | 2/2019 | Kofman | A61B 5/0075 |

FOREIGN PATENT DOCUMENTS

| | | | | |
|---|---|---|---|---|
| CN | 105451111 | A | | 3/2016 |
| CN | 105491469 | A | | 4/2016 |
| CN | 105759944 | A | | 7/2016 |
| CN | 106161804 | A | | 11/2016 |
| CN | 106535023 | A | | 3/2017 |
| CN | 108496374 | A | | 9/2018 |
| CN | 108632703 | A | * | 10/2018 |
| CN | 108702567 | A | | 10/2018 |

* cited by examiner

INTERACTIVE CONTROL METHOD AND DEVICE OF EARPHONES, EARPHONE AND STORAGE MEDIUM

CROSS-REFERENCE TO RELATED APPLICATIONS

This Application is a U.S. National-Stage entry under 35 U.S.C. § 371 based on International Application No. PCT/CN2018/125261, filed Dec. 29, 2018 which was published under PCT Article 21(2) and which claims priority to Chinese Application Nos. 201811271607.8, filed Oct. 29, 2018, and 201811332529.8, filed Nov. 9, 2018, which are all hereby incorporated herein in their entirety by reference.

TECHNICAL FIELD

This Application pertains to the technical field of earphones, in particular to an interactive control method and device of earphones, an earphone and a storage medium.

BACKGROUND

With the rapid development of artificial intelligence, more and more functions can be realized by smart terminals, and the user's requirements in function realization are increasingly higher. It needs to be solved urgently how to better realize human-computer interaction and terminal—terminal interaction, and further improve user experience. In addition, other objects, desirable features and characteristics will become apparent from the subsequent summary and detailed description, and the appended claims, taken in conjunction with the accompanying drawings and this background.

SUMMARY

The present disclosure provides an interactive control method and device of earphones, an earphone and a storage medium, which further perfects and improves the details of function realization and improves user experience.

According to an aspect of the present disclosure, there is provided an interactive control method of earphones, the earphones comprise a first earphone and a second earphone, and the method comprises:

acquiring putting-on sequential order information or taking-off sequential order information of the first earphone and/or the second earphone;

determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and sending the first functional instruction or the second functional instruction to the mobile terminal, so that the mobile terminal executes the first functional instruction or the second functional instruction to realize the first interaction function or the second interaction function with the earphones.

According to another aspect of the present disclosure, there is provided an interactive control device of earphones, the earphones comprise a first earphone and a second earphone, and the device comprises:

an acquiring module for acquiring putting-on sequential order information or taking-off sequential order information of the first earphone and/or the second earphone;

an instruction determining module for determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and a control module for sending the first functional instruction or the second functional instruction to the mobile terminal, so that the mobile terminal executes the first functional instruction or the second functional instruction to realize the first interaction function or the second interaction function with the earphones.

According to still another aspect of the present disclosure, there is provided an earphone comprising:

a detection sensor for detecting putting-on sequential order information or taking-off sequential order information of the first earphone and/or the second earphone;

a processor for determining a first functional instruction corresponding to the putting-on sequential order information or a second functional instruction corresponding to the taking-off sequential order information according to a preset correspondence between the putting-on sequential order information or the taking-off sequential order information output by the detection sensor and functional instructions of a mobile terminal; and a communication device for sending the first functional instruction or the second functional instruction to the mobile terminal, so that the mobile terminal executes the first functional instruction or the second functional instruction to realize the first interaction function or the second interaction function with the earphones.

According to yet still another aspect of the present disclosure, there is provided a computer-readable storage medium having a computer program stored thereon, and when the computer program is executed by a processor, the above method described in an aspect of the present disclosure is implemented.

The following beneficial effects can be achieved. The interactive control method and device of earphones according to the one of embodiments of the present disclosure acquire putting-on sequential order information or taking-off sequential order information of the first earphone and/or the second earphone, determine a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal, and send the first functional instruction or the second functional instruction to the mobile terminal, so that the mobile terminal executes the first functional instruction or the second functional instruction to realize the first interaction function or the second interaction function with the earphones. Thus, one of embodiments of the present disclosure control the mobile terminal to realize different interaction functions with the earphone based on the putting-on or taking-off sequential order of the first earphone or the second earphone, enrich the control methods of the earphone and the mobile terminal, satisfies the user's control requirements for function switching of the earphone or the mobile phone, improve user experience, make the human-computer interaction and the interaction between earphone and mobile terminal more intelligent and convenient, and improve the market competitiveness of products. The earphones according to the one of embodiments of the present disclosure can intelligently detect the putting-on or taking-off sequential order of different earphones, and control the mobile terminal to complete different interaction functions with the earphones based on putting-on or taking-off sequential order, so the degree of intelligence is higher, and the user experience is good.

BRIEF DESCRIPTION OF DRAWINGS

The present invention will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

In order to make the objectives, features, and advantages of the present application clearer, the present disclosure will be further described in details in conjunction with the drawings and specific embodiments. Obviously, the embodiments described are only part of, rather than all of, the embodiments of the present disclosure. Based on the embodiments in the present disclosure, all other embodiments obtained by a person of ordinary skill in the art without paying creative work shall fall within the protection scope of the present disclosure.

Figure 1:
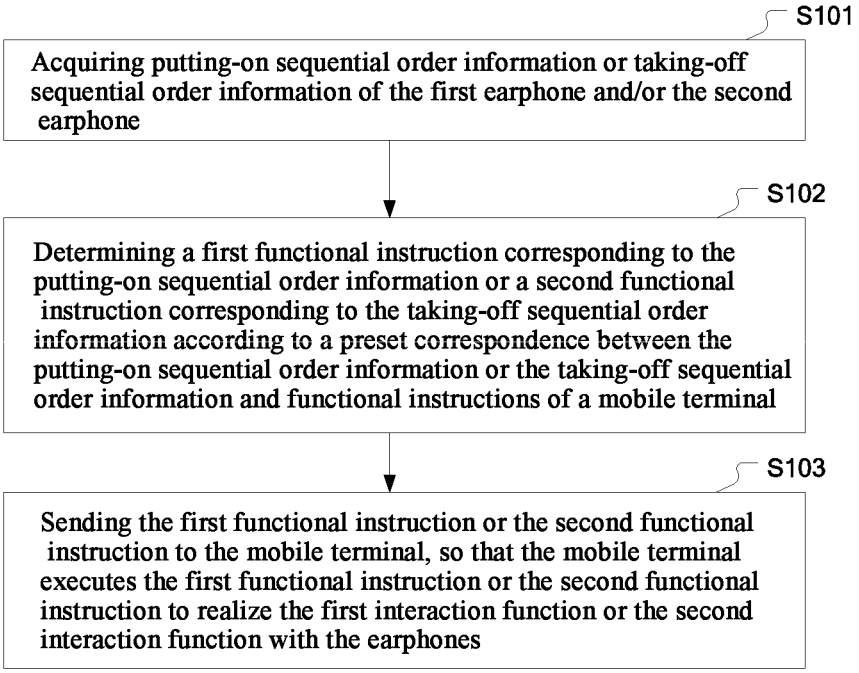
FIG. 1 is a schematic flow chart of an interactive control method of earphones according to an embodiment of the present disclosure.

FIG. 1 is a schematic flowchart of an interactive control method of earphones according to an embodiment of the present disclosure. Referring to FIG. 1, in the present embodiment, the earphones include a first earphone and a second earphone, and the interactive control method of earphones comprises the following steps:

Step S101: acquiring putting-on sequential order information or taking-off sequential order information of the first earphone and/or the second earphone;

Step S102: determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and Step S103: sending the first functional instruction or the second functional instruction to the mobile terminal, so that the mobile terminal executes the first functional instruction or the second functional instruction to realize the first interaction function or the second interaction function with the earphones.

As shown in FIG. 1, the interactive control method of earphones of the present embodiment realizes the functional interaction between the earphones and the mobile terminal based on the acquired putting-on sequential order information or taking-off sequential order information of the first earphone and/or the second earphone. That is to say, a different putting-on or taking-off sequential order realizes a different interactive function. In this way, the user's needs for diversified switching functions are satisfied, and the user experience is improved, so that the user can control and complete the function selection and switching only by putting-on or taking off the earphones in different sequential order, the degree of intelligence is higher, and the human-computer interaction is faster and more convenient.

In an embodiment of the present disclosure, the mode of acquiring putting-on sequential order information or taking-off sequential order information of the first earphone and/or the second earphone comprises: acquiring an earphone identifier corresponding to putting-on or taking-off in a process of putting-on or taking-off, and according to the earphone identifier determining putting-on sequential order information or taking-off sequential order information of the first earphone, or putting-on sequential order information or taking-off sequential order information of the second earphone, or putting-on sequential order information or taking-off sequential order information of the first earphone and the second earphone.

Typically, earphones are used in pairs. In other words, when using the earphones, users usually use the first earphone and the second earphone at the same time, and wear the first earphone and the second earphone in the left and right ear canals to listen to the sounds. Considering that in actual situations, there may be a situation where a single earphone is used, for example, only the first earphone is used and the second earphone is not used. In an embodiment of the present disclosure, an earphone identifier corresponding to putting-on or taking-off in a process of putting-on or taking-off is acquired to determine the putting-on sequential order information or taking-off sequential order information of the earphones in three situations, namely, (1) the putting-on sequential order information or taking-off sequential order information of the first earphone; (2) the putting-on sequential order information or taking-off sequential order information of the second earphone; (3) the putting-on sequential order information or taking-off sequential order information of the first earphone and the second earphone.

Since in reality, the third situation (i.e., using the first earphone and the second earphone at the same time) is the habit of most people, in the following embodiments, the description is given priority to the situation (3) where the information acquired is the putting-on sequential order information or taking-off sequential order information of the first earphone and the second earphone.

Figure 2:
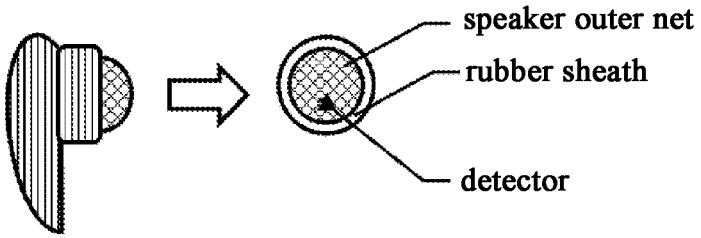
FIG. 2 is a schematic diagram of the structure of an earphone according to an embodiment of the present disclosure.

In the present embodiment, the putting-on sequential order information acquired includes: sequential order information of putting-on switching electrical signals acquired when a user first puts the first earphone on a first ear and then puts the second earphone on a second ear; the taking-off sequential order information acquired includes: sequential order information of taking-off switching electrical signals acquired when a user first takes the first earphone off a first ear and then takes the second earphone off a second ear. Referring to FIG. 2, in the present embodiment, it is described by taking the wireless earphone as an example of earphone. FIG. 2 shows an earphone comprising a speaker outer net and a rubber sheath, and the earphone is further provided with a detector which detects the putting-on or taking-off state of the earphone. In an embodiment, the sequential order information of putting-on switching electrical signals acquired includes: a corresponding putting-on switching electrical signal acquired when the earphone switches from a non-wearing state to a wearing state after the user puts the first earphone on the first ear or puts the second earphone on the second ear; the sequential order information of taking-off switching electrical signals acquired includes: a corresponding taking-off switching electrical signal acquired when the earphone switches from a wearing state to a non-wearing state after the user takes the first earphone off the first ear or takes the second earphone off the second ear.

That is to say, when the user puts the earphone on the ear, the detector on the earphone can detect that the earphone switches from the non-wearing state to the wearing state, and at this point, the corresponding detector generates a putting-on switching electrical signal. Correspondingly, when the user takes the earphone off the ear, the detector on the earphone can detect that the earphone switches from the wearing state to the non-wearing state, and at this point, the corresponding detector generates a taking-off switching electrical signal. When the user puts on the earphones in a different sequential order, the corresponding sequential order of putting-on switching electrical signals is also different. This sequential order is the sequential order between the first earphone and the second earphone. Similarly, an earphone identifier corresponding to putting-on or taking-off in a process of putting-on or taking-off is also acquired through the detection sensor. Namely, according to first current information of a first current passing through the built-in resistor of the first detection sensor, the earphone identifier of the first earphone corresponding to the first current information is determined; according to second current information of a second current passing through the built-in resistor of the second detection sensor, the earphone identifier of the second earphone corresponding to the second current information is determined.

Figure 3:
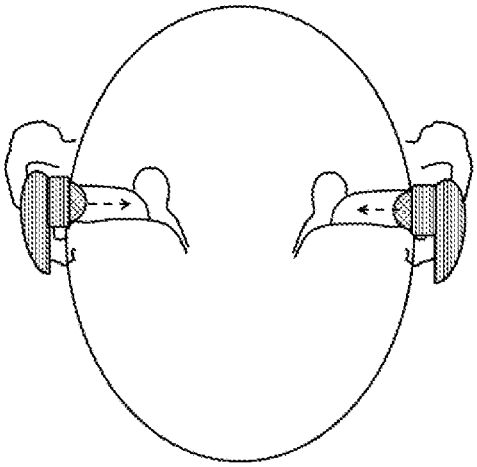
FIG. 3 is a schematic diagram of earphone putting-on detection according to an embodiment of the present disclosure.

Referring to FIG. 3 which is a schematic diagram of putting-on detection of a wireless earphone in an embodiment, acquiring putting-on sequential order information of the first earphone and the second earphone comprises: acquiring a first putting-on switching electrical signal generated by a first detection sensor on the first earphone in response to a current value change after the user puts the first earphone on the first ear; acquiring a second putting-on switching electrical signal generated by a second detection sensor on the second earphone in response to a current value change after the user puts the second earphone on the second ear; wherein a resistance value of a built-in resistor of the first detection sensor is different from a resistance value of a built-in resistor of the second detection sensor, and the first putting-on switching electrical signal is acquired before the second putting-on switching electrical signal is acquired.

Correspondingly, acquiring taking-off sequential order information of the first earphone and the second earphone comprises: acquiring a first taking-off switching electrical signal generated by a first detection sensor on the first earphone in response to a current value change after the user takes the first earphone off the first ear; acquiring a second taking-off switching electrical signal generated by a second detection sensor on the second earphone in response to a current value change after the user takes the second earphone off the second ear; wherein the first taking-off switching electrical signal is acquired before the second taking-off switching electrical signal is acquired.

It can be seen from the above that, in an embodiment of the present disclosure, the first detection sensor is provided on the first earphone, the second detection sensor is provided on the second earphone, and the resistance values of the built-in resistors of the first detection sensor and the second detection sensor are different so that the detection sensors can be distinguished. Since the resistance values are different, the currents flowing through the sensors must be different. According to different current values, the putting-on sequential order of the first earphone or the second earphone is determined, or the taking-off sequential order of the first earphone or the second earphone is determined.

In the wearing state, the current value of the detection sensor is equal to a value or within a range of values. When the earphone switches from the wearing state to the taking-off state within a preset time period (5 seconds), the value of the current flowing through the detection sensor will change, for example, from the current value corresponding to a value of 0 to the current value corresponding to a value of 1. In the present embodiment, the putting-on and taking-off states of the same earphone is distinguished based on the change (or switching) of the current value within the preset time period. That is to say, the first detection sensor on the first earphone generates a first putting-on switching electrical signal in response to a current value change after the user puts the first earphone on the first ear. The first detection sensor generates a first taking-off switching electrical signal in response to a current value change after the user takes the first earphone off the first ear. In the same way, the second detection sensor of the second earphone can detect the putting-on or taking off state of the second earphone.

Figure 4:
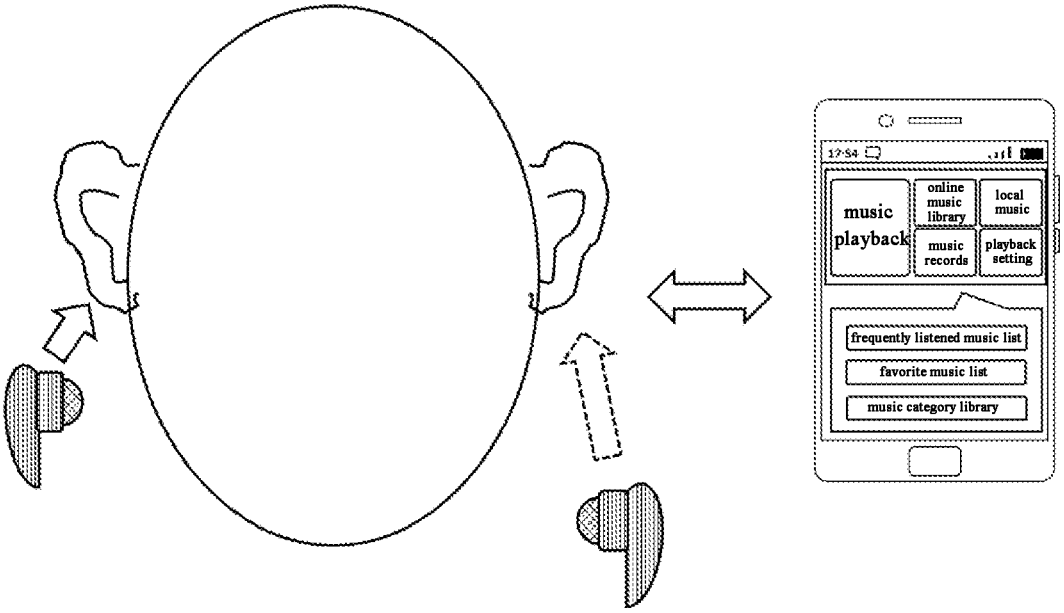
FIG. 4 is a schematic diagram of the putting-on sequential order of the left earphone and the right earphone and the control functions according to an embodiment of the present disclosure.

Referring to FIG. 4, in an embodiment, when the first earphone is the left earphone and the second earphone is the right earphone, the method shown in FIG. 1 acquires the putting-on sequential order information of the left earphone and the right earphone, and determines a first functional instruction corresponding to the putting-on sequential order information according to a preset correspondence between the putting-on sequential order information and functional instructions of a mobile terminal; the first functional instruction includes at least one of the following functional instructions: a functional instruction instructing to establish a connection with the earphones, a functional instruction instructing to run a music application in the mobile terminal, and a functional instruction instructing to display a frequently listened music playlist of the user in the music application and play music through the earphones.

In FIG. 4, the left earphone is the earphone first put on by the user. In FIG. 4, a mobile phone is taken as an example of the mobile terminal. When the user first puts on the left earphone, and then puts on the right earphone, according to such putting-on sequential order information of the left earphone and the right earphone acquired, the preset correspondence between the putting-on sequential order information and functional instructions of the mobile terminal is looked up, and the first functional instruction corresponding to the putting-on sequential order information is determined.

In the present embodiment, the first functional instruction includes: an instruction to establish a wireless connection with the earphones (see the two-way arrow between the mobile phone and the earphone in FIG. 4), an instruction to run a music application on the mobile phone (see "music playback" in FIG. 4), an instruction to display the "frequently listened music list", "favorite music list" or "music category library" of the music application on the mobile phone, and an instruction to play through the earphones. It can be understood that the interface illustrated in FIG. 4 is only used to illustrate the content of the first functional instruction in the embodiment of the present disclosure, and the content of the first functional instruction in the embodiment of the present disclosure is not limited to the illustration in FIG. 4. For example, it may also include an instruction to turn on the sound equalizer installed on the mobile phone. In actual uses, the first functional instruction may be defined according to needs.

As shown in FIG. 4, the user only needs to first put the left earphone and then put the right earphone on the ears to realize the function of controlling the mobile phone to play the music on the mobile phone through the earphones, which greatly improves the interactive experience between the user and the earphones, and improves the intelligence degree of the earphones.

Figure 5:
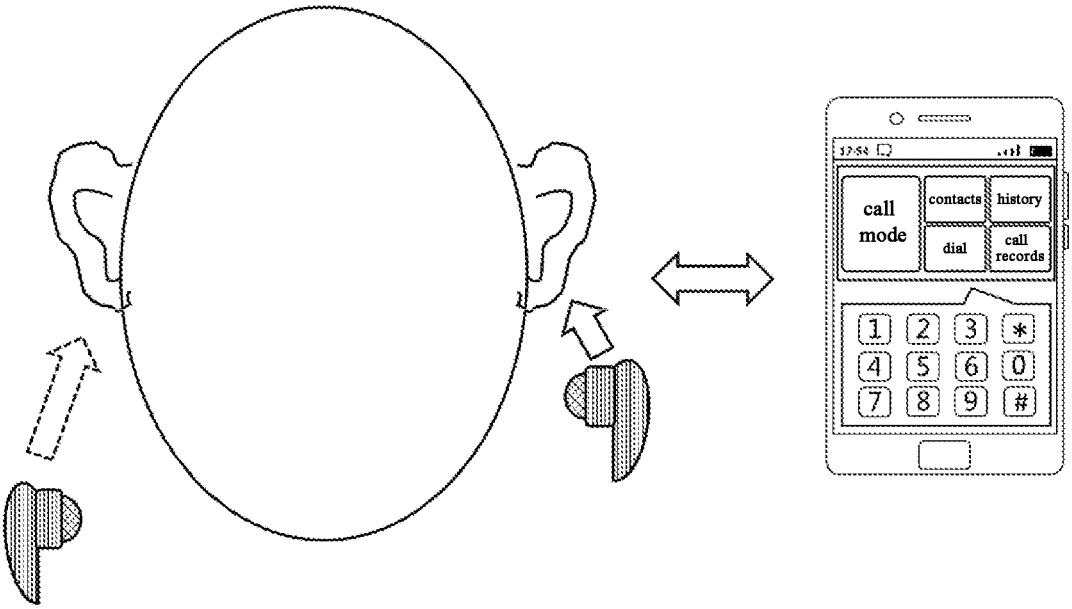
FIG. 5 is a schematic diagram of the putting-on sequential order of the right earphone and the left earphone and the control functions according to an embodiment of the present disclosure.

Referring to FIG. 5, in another embodiment of the present disclosure, the first earphone is the right earphone, and the second earphone is the left earphone; putting-on sequential order information of the right earphone and the left earphone is acquired, and a first functional instruction corresponding to the putting-on sequential order information is determined according to a preset correspondence between the putting-on sequential order information and functional instructions of a mobile terminal; the first functional instruction includes at least one of the following functional instructions: a functional instruction instructing the mobile terminal to turn on a call mode, a functional instruction instructing the mobile terminal to display a dial interface to receive a phone number input by a user, or a functional instruction instructing the mobile terminal to answer an incoming call through the earphones.

As shown in FIG. 5, in another embodiment of the present disclosure, when the user first puts the right earphone on one ear, and then puts the left earphone on the other ear, the earphones determine a corresponding first functional instruction based on such putting-on sequential order information of the right earphone and the left earphone. In the present embodiment, the first functional instruction includes an instruction to turn on the call mode of the mobile phone, as shown by the "call mode" in FIG. 5. It may also include more specific instructions in the call mode, for example, an instruction to display the "contacts" in the mobile phone, an instruction to display the "history", and an instruction to display the dial (see the number dial in the lower half of the current interface of the mobile phone in FIG. 5). In this way, the user can control the mobile phone through the earphones to turn on the call mode of the mobile phone only by putting-on the right earphone and the left earphone on the ears in a sequential order, which is convenient for the user to make or receive a call and play the call through the earphones, thereby improving user experience.

Similar to the above putting-on process, during the taking-off process, the sequential order of the left and right earphones can also be distinguished, and the control of different functions can be achieved based on the taking-off sequential order of the left and right earphones. Specifically, in an embodiment of the present disclosure, the first earphone is a left earphone, and the second earphone is a right earphone; taking-off sequential order information of the left earphone and the right earphone is acquired, and a second functional instruction corresponding to the taking-off sequential order information is determined according to a preset correspondence between the taking-off sequential order information and functional instructions of a mobile terminal; the second functional instruction includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off the connection with the earphones.

In another embodiment of the present disclosure, the first earphone is the right earphone, and the second earphone is the left earphone; taking-off sequential order information of the right earphone and the left earphone is acquired, and a second functional instruction corresponding to the taking-off sequential order information is determined according to a preset correspondence between the taking-off sequential order information and functional instructions of a mobile terminal; the second functional instruction includes at least one of the following functional instructions: a functional instruction instructing to play a call voice through a speaker in the mobile terminal, a functional instruction instructing to turn off the connection with the earphones, or a functional instruction instructing the mobile terminal to hang up.

In an embodiment of the present disclosure, besides controlling the mobile phone to execute some instructions related to the interactive function with the earphones based on the putting-on sequential order information or the taking-off sequential order information, the earphones can also control themselves to realize the interactive functions with the mobile terminal such as the mobile phone. That is to say, the interactive control method of the earphones comprises: determining a third functional instruction corresponding to the putting-on sequential order information or a fourth functional instruction corresponding to the taking-off sequential order information according to a preset correspondence between the putting-on sequential order information or the taking-off sequential order information and functional instructions of the earphones; and controlling the earphones to execute the third functional instruction or the fourth functional instruction to realize a third interaction function or a fourth interaction function with the mobile terminal.

For example, a third functional instruction corresponding to the putting-on sequential order information is determined according to a preset correspondence between the putting-on sequential order information and functional instructions of the earphones; the third functional instruction includes at least one of the following functional instructions: a functional instruction instructing the earphones to establish a connection with the mobile terminal, a functional instruction instructing the earphones to enter a standby playback mode, and a functional instruction instructing the earphones to play music or answer a call.

For another example, a fourth functional instruction corresponding to the taking-off sequential order information is determined according to a preset correspondence between the taking-off sequential order information and functional instructions of the earphones; the fourth functional instruction includes at least one of the following functional instructions: a functional instruction instructing the earphones to enter a standby playback mode, a functional instruction instructing the earphones to turn off the connection with the mobile terminal, and a functional instruction instructing the earphones to enter a power saving mode.

As mentioned above, in actual situations, there may be a situation where a single earphone is used, for example, only the first earphone is used and the second earphone is not used. With respect to this situation, the interactive control method of earphones according to an embodiment of the present disclosure comprises: when the earphone identifier indicates that there is only the putting-on information or the taking-off information of the first earphone, a fifth functional instruction corresponding to the putting-on information or a sixth functional instruction corresponding to the taking-off information is determined according to a preset correspondence between the putting-on information or the taking-off information and functional instructions of a mobile terminal; the fifth functional instruction or the sixth functional instruction is sent to the mobile terminal, so that the mobile terminal executes the fifth functional instruction or the sixth functional instruction to realize a fifth interaction function or a sixth interaction function with the earphone.

In an embodiment, the first earphone is a left earphone. The fifth functional instruction corresponding to the putting-on information is determined according to a preset correspondence between the putting-on information of the left earphone and functional instructions of the mobile terminal; the fifth functional instruction includes at least one of the following functional instructions: a functional instruction instructing to establish a connection with the earphone, a functional instruction instructing to run a music application in the mobile terminal, and a functional instruction instructing to display a frequently listened music playlist of the user in the music application and play music through the earphone.

That is to say, when the user only uses the left earphone in a process of use, the fifth functional instruction is determined according to the putting-on information of the left earphone acquired and the preset correspondence, and is sent to the mobile phone. After the fifth functional instruction is executed by the mobile phone, the functions such as establishing a connection between the mobile phone and the earphone and running the music application in the mobile phone can be realized, and the user is not required to wear both the left earphone and the right earphone. It should be noted that, in this situation, the user only puts on the left earphone, so compared to the right earphone that is not worn, it is still appropriate to say that the user puts on the left earphone first.

In an embodiment of the present disclosure, the first earphone is the left earphone. When the earphone identifier indicates that there is only information of the left earphone, the sixth functional instruction corresponding to the taking-off sequential order information is determined according to a preset correspondence between the taking-off sequential order information of the left earphone and the functional instructions of the mobile terminal. The sixth functional instruction includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off the connection with the earphone.

When the user only puts on the left earphone and there is an operation of taking off the left earphone after use, the sixth functional instruction is determined according to the taking-off information of the left earphone acquired and the preset correspondence, and is sent to the mobile phone. After the sixth functional instruction is executed by the mobile phone, the functions such as pausing the music playback or stopping the music application can be realized.

Similarly, the first earphone may also be the right earphone. When the earphone identifier indicates that there is only information of the right earphone, the fifth functional instruction corresponding to the putting-on information is determined according to a preset correspondence between the putting-on information of the right earphone and the functional instructions of the mobile terminal. The fifth functional instruction includes at least one of the following functional instructions: a functional instruction instructing the mobile terminal to turn on a call mode, a functional instruction instructing the mobile terminal to display a dial interface to receive a phone number input by a user, or a functional instruction instructing the mobile terminal to answer an incoming call through the earphone.

In an embodiment, the first earphone is the right earphone. When the earphone identifier indicates that there is only information about the right earphone, the sixth functional instruction corresponding to the taking-off information is determined according to a preset correspondence between the taking-off information of the right earphone and the functional instructions of the mobile terminal. The sixth functional instruction includes at least one of the following functional instructions: a functional instruction instructing to play a call voice through a speaker in the mobile terminal, a functional instruction instructing to turn off the connection with the earphone, or a functional instruction instructing the mobile terminal to hang up.

Since the interactive control process of the right earphone is similar to the above interactive control process of the left earphone, it will not be repeated here, and may refer to the above description of the interactive control process of putting-on or taking-off of the left earphone.

The implementation steps of the interactive control method of earphones according to an embodiment of the present disclosure will be described as follows with reference to a specific application scenario.

In terms of structural hardware, the application scenario includes a mobile phone, and left and right earphones used with the mobile phone. The left earphone is provided with a first detector, and the right earphone is provided with a second detector. The first detector can detect whether the earphone is worn on the user's ear and is used to generate a left ear instruction A and a left ear instruction a; the second detector can detect whether the earphone is worn on the user's ear and is used to generate a right ear instruction B and a right ear instruction b.

The left earphone is provided with a third detector, and the right earphone is provided with a fourth detector. The third detector can detect whether the earphone is worn on the user's ear, and is used to generate a left ear instruction M and a left ear instruction m; the fourth detector can detect whether the earphone is worn on the user's ear and is used to generate a right ear instruction N and a right ear instruction n.

The left earphone is provided with a fifth detector, and the right earphone is provided with a sixth detector. The fifth detector can detect whether the earphone is worn on the user's ear and is used to generate a left ear instruction E and a left ear instruction e; the sixth detector can detect whether the earphone is worn on the user's ear and is used to generate a right ear instruction F and a right ear instruction f.

The first, third and fifth detectors on the left earphone, and the second, fourth and sixth detectors on the right earphone can all be infrared sensors for detecting the temperature in the ear canal. For example, the infrared sensor can detect the temperature value range in the ear canal of the user, and determine whether the user is wearing the earphone according to the temperature value range.

Specifically, when the left earphone is worn in the user's ear canal, an instruction is generated which is an electrical signal transmitted from an infrared sensor and the electrical signal can represent the 0-1 switching; when the left earphone is taken off, an instruction is generated which is an electrical signal transmitted from an infrared sensor and the electrical signal can represent the 1-0 switching. In other words, when the earphone is put on, the infrared sensor gives a value of 1; when the earphone is taken off, the infrared sensor gives a value of 0; when the 0-1 switching is output within a specified time (what is output is not a fixed value but a change of value), it indicates that the user puts on the earphone; when the 1-0 switching is output, it indicates that the user takes off the earphone.

In addition, the first, third and fifth detectors of the left earphone are different from the second, fourth and sixth detectors of the corresponding right earphone. The electrical signals detected by them are different due to the difference in the built-in resistor of the sensor (such as different resistance values) and the difference in the output current, specifically, the electrical signals may be a 0-2 switching or a 2-0 switching.

The first, third and fifth detectors of the left earphone may be the same detector $\alpha$, and the second, fourth and sixth detectors of the corresponding right earphone may also be the same detector $\beta$. By predefining, a total of four switching combinations (i.e., the output of detector $\alpha$ is 1-0 or 0-1 switching, and the output of detector $\beta$ is 2-0 or 0-2 switching), and different outputting sequential orders within a preset time realize different outputs of control instructions. For example, when within 5 seconds, the detector $\alpha$ outputs a 0-1 switching, and the detector $\beta$ outputs a 0-2 switching, it indicates that the user first puts on the left earphone, and then puts on the right earphone. When within 5 seconds, the detector $\alpha$ outputs a 1-0 switching and the detector $\beta$ outputs a 2-0 switching, it indicates that the user first takes off the left earphone, and then takes off the right earphone.

In terms of specific software implementation, (I) With Respect to the Putting-On Process (1) when the user first puts on the left earphone, the system first receives the left ear instruction A, which is configured to be sent to the user's mobile phone to instruct the user's mobile phone to run the music application, and at the same time, is configured to be sent to the left and right earphones to instruct the left and right earphones to establish a wireless connection with the mobile phone and enter the standby playback mode. When the user continues to put on the right earphone, the system then receives the right ear instruction B, which is configured to be sent to the user's mobile phone to instruct the user's mobile phone to display the "frequently listened music playlist" of the user in the music application and play music through the earphones.

(2) when the user first puts on the right earphone, the system first receives the right ear instruction b, which is configured to be sent to the user's mobile phone to instruct the user's mobile phone to turn on the call mode, and at the same time, is configured to be sent to the left and right earphones to instruct the left and right earphones to enter the standby playback mode. When the user continues to put on the left earphone, the system receives the left ear instruction a, which is configured to be sent to the user's mobile phone to instruct the user's mobile phone to answer a call in the user's mobile phone, and play it to the user through the earphones, or when the user's mobile phone does not receive a call, directly control to display the dial of the mobile phone and wait for the user to input a mobile phone number.

(II) With Respect to the Taking-Off Process

The taking-off process is divided into taking-off during music playback and taking-off during calling.

Specifically, in the case of music playback, (1) when the user first takes off the left earphone, the system first receives the left ear instruction M, which is configured to be sent to the user's mobile phone to instruct the user's mobile phone to pause the music playing of the music application, and at the same time, is configured to send to the left and right earphones to instruct the left and right earphones to enter the standby playback mode. When the user continues to take off the right earphone, the system continues to receive the right ear instruction N, which is configured to be sent to the user's mobile phone to control the user's mobile phone to stop the music, and at the same time, is configured to send to the left and right earphones to instruct the left and right earphones to turn off the wireless connection with the mobile phone and enter the power saving mode.

(2) when the user first takes off the right earphone, the system first receives the right ear instruction n, which is configured to be sent to the user's mobile phone to control the speaker of the mobile phone to play music (i.e., play music through speaker), and at the same time, is configured to send to the left and right earphones to instruct the left and right earphones to enter the standby playback mode. When the user continues to take off the left earphone, the system continues to receive the left ear instruction m, which is configured to turn off the wireless connection between the left and right earphones and the mobile phone, and instruct the left and right earphones to enter the power saving mode.

In the case of calling, (1) when the user first takes off the right earphone, the system first receives the right ear instruction F, which is configured to be sent to the user's mobile phone to control to turn off the calling mode (to hang up the call) of the mobile phone, and is configured to send to the left and right earphones to instruct the left and right earphones to enter the standby playback mode. When the user continues to take off the left earphone, the system continues to receive the left ear instruction E, which is configured to be sent to the user's mobile phone to control to turn off the wireless connection between the left and right earphones and the mobile phone, and instruct the left and right earphones to enter the power saving mode.

(2) when the user first takes off the left earphone, the system first receives the left ear instruction e, which is configured to be sent to the user's mobile phone to control the speaker of the mobile phone to play the call (i.e., play the call through speaker), and at the same time, is configured to send to the left and right earphones to instruct the left and right earphones to enter the standby playback mode. When the user continues to take off the right earphone, the system continues to receive the right earphone command f, which is configured to be sent to the user's mobile phone to control to turn off the wireless connection between the left and right earphones and the mobile phone, and instruct the left and right earphones to enter the power saving mode.

Thus, as stated above, the control instructions are generated based on the putting-on or taking-off sequential order of the left and right earphones to control the function selection or switching of the earphones and the mobile phone, which enriches the interaction ways between the earphones and the user or between the earphones and other mobile terminals, and improves user experience.

Based on the same inventive concept as the above interactive control method of earphones, an embodiment of the present disclosure provides an interactive control device of earphones. The earphones comprise a first earphone and a second earphone. The interactive control device 600 of the earphones comprises:

an acquiring module 601 for acquiring putting-on sequential order information or taking-off sequential order information of the first earphone and/or the second earphone;

an instruction determining module 602 for determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and a control module 603 for sending the first functional instruction or the second functional instruction to the mobile terminal, so that the mobile terminal executes the first functional instruction or the second functional instruction to realize the first interaction function or the second interaction function with the earphones.

In an embodiment of the present disclosure, the acquiring module 601 is specifically for acquiring an earphone identifier corresponding to putting-on or taking-off in a process of putting-on or taking-off, and according to the earphone identifier determining putting-on sequential order information or taking-off sequential order information of the first earphone, or putting-on sequential order information or taking-off sequential order information of the second earphone, or putting-on sequential order information or taking-off sequential order information of the first earphone and the second earphone.

In an embodiment of the present disclosure, the putting-on sequential order information acquired includes: sequential order information of putting-on switching electrical signals acquired when a user first puts the first earphone on a first ear and then puts the second earphone on a second ear; the taking-off sequential order information acquired includes: sequential order information of taking-off switching electrical signals acquired when a user first takes the first earphone off a first ear and then takes the second earphone off a second ear.

In an embodiment of the present disclosure, the sequential order information of putting-on switching electrical signals acquired by the acquiring module 601 includes: a corresponding putting-on switching electrical signal acquired when the earphone switches from a non-wearing state to a wearing state after the user puts the first earphone on the first ear or puts the second earphone on the second ear; the sequential order information of taking-off switching electrical signals acquired by the acquiring module 601 includes: a corresponding taking-off switching electrical signal acquired when the earphone switches from a wearing state to a non-wearing state after the user takes the first earphone off the first ear or takes the second earphone off the second ear.

In an embodiment of the present disclosure, the first earphone is a left earphone, and the second earphone is a right earphone; putting-on sequential order information of the left earphone and the right earphone is acquired, and a first functional instruction corresponding to the putting-on sequential order information is determined according to a preset correspondence between the putting-on sequential order information and functional instructions of a mobile terminal; the first functional instruction includes at least one of the following functional instructions: a functional instruction instructing to establish a connection with the earphones, a functional instruction instructing to run a music application in the mobile terminal, and a functional instruction instructing to display a frequently listened music playlist of the user in the music application and play music through the earphones.

In an embodiment of the present disclosure, the first earphone is a right earphone, and the second earphone is a left earphone; putting-on sequential order information of the right earphone and the left earphone is acquired, and a first functional instruction corresponding to the putting-on sequential order information is determined according to a preset correspondence between the putting-on sequential order information and functional instructions of a mobile terminal; the first functional instruction includes at least one of the following functional instructions: a functional instruction instructing the mobile terminal to turn on a call mode, a functional instruction instructing the mobile terminal to display a dial interface to receive a phone number input by a user, or a functional instruction instructing the mobile terminal to answer an incoming call through the earphones.

In an embodiment of the present disclosure, the first earphone is a left earphone, and the second earphone is a right earphone; taking-off sequential order information of the left earphone and the right earphone is acquired, and a second functional instruction corresponding to the taking-off sequential order information is determined according to a preset correspondence between the taking-off sequential order information and functional instructions of a mobile terminal; the second functional instruction includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off the connection with the earphones.

In an embodiment of the present disclosure, the first earphone is a right earphone, and the second earphone is a left earphone; taking-off sequential order information of the right earphone and the left earphone is acquired, and a second functional instruction corresponding to the taking-off sequential order information is determined according to a preset correspondence between the taking-off sequential order information and functional instructions of a mobile terminal; the second functional instruction includes at least one of the following functional instructions: a functional instruction instructing to play a call voice through a speaker in the mobile terminal, a functional instruction instructing to turn off the connection with the earphones, or a functional instruction instructing the mobile terminal to hang up.

In an embodiment of the present disclosure, the acquiring module 601 is specifically for acquiring a first putting-on switching electrical signal generated by a first detection sensor on the first earphone in response to a current value change after the user puts the first earphone on the first ear; and acquiring a second putting-on switching electrical signal generated by a second detection sensor on the second earphone in response to a current value change after the user puts the second earphone on the second ear; wherein a resistance value of a built-in resistor of the first detection sensor is different from a resistance value of a built-in resistor of the second detection sensor, and the first putting-on switching electrical signal is acquired before the second putting-on switching electrical signal is acquired.

In an embodiment of the present disclosure, acquiring taking-off sequential order information of the first earphone and the second earphone comprises: acquiring a first taking-off switching electrical signal generated by a first detection sensor on the first earphone in response to a current value change after the user takes the first earphone off the first ear; and acquiring a second taking-off switching electrical signal generated by a second detection sensor on the second earphone in response to a current value change after the user takes the second earphone off the second ear; wherein a resistance value of a built-in resistor of the first detection sensor is different from a resistance value of a built-in resistor of the second detection sensor, and the first taking-off switching electrical signal is acquired before the second taking-off switching electrical signal is acquired.

In an embodiment of the present disclosure, acquiring an earphone identifier corresponding to putting-on or taking-off in a process of putting-on or taking-off comprises: according to first current information of a first current passing through the built-in resistor of the first detection sensor, determining the earphone identifier of the first earphone corresponding to the first current information; and according to second current information of a second current passing through the built-in resistor of the second detection sensor, determining the earphone identifier of the second earphone corresponding to the second current information.

Figure 6:
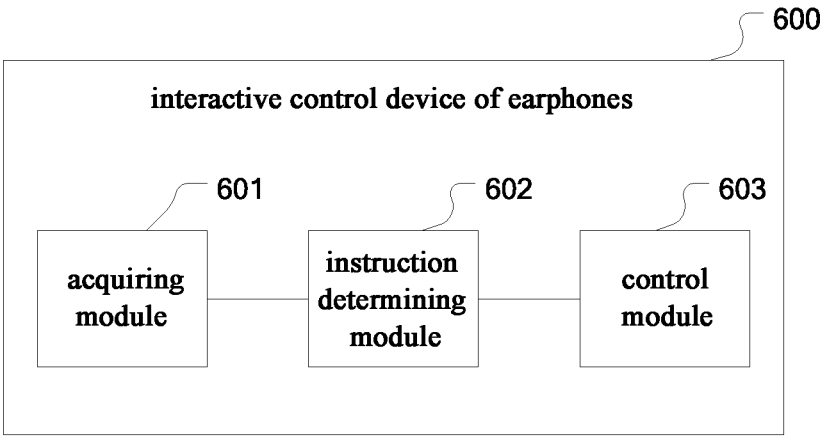
FIG. 6 is a block diagram of an interactive control device of earphones according to an embodiment of the present disclosure.
Figure 7:
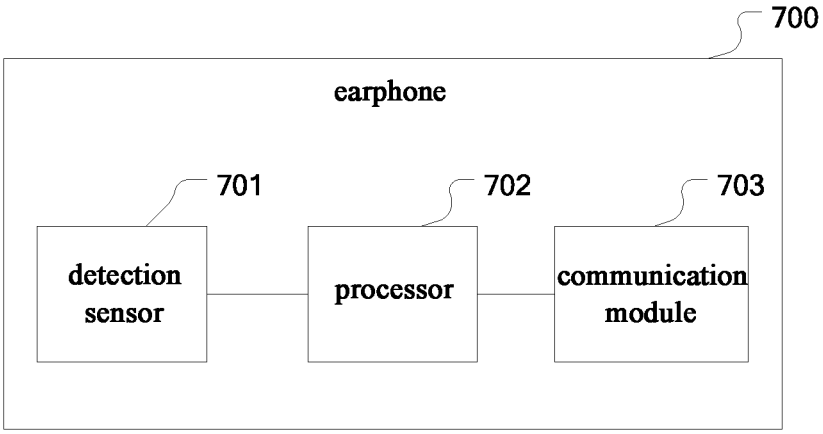
FIG. 7 is a block diagram of an earphone according to an embodiment of the present disclosure.

In an embodiment of the present disclosure, the device shown in FIG. 6 comprises: a self-control module for determining a third functional instruction corresponding to the putting-on sequential order information or a fourth functional instruction corresponding to the taking-off sequential order information according to a preset correspondence between the putting-on sequential order information or the taking-off sequential order information and functional instructions of an earphone; and controlling the earphone to execute the third functional instruction or the fourth functional instruction to realize a third interaction function or a fourth interaction function with the mobile terminal.

Specifically, the third functional instruction corresponding to the putting-on sequential order information is determined according to a preset correspondence between the putting-on sequential order information and functional instructions of an earphone; the third functional instruction includes at least one of the following functional instructions: a functional instruction instructing an earphone to establish a connection with the mobile terminal, a functional instruction instructing an earphone to enter a standby playback mode, and a functional instruction instructing an earphone to play music or answer a call. Or, the fourth functional instruction corresponding to the taking-off sequential order information is determined according to a preset correspondence between the taking-off sequential order information and functional instructions of an earphone; the fourth functional instruction includes at least one of the following functional instructions: a functional instruction instructing an earphone to enter a standby playback mode, a functional instruction instructing an earphone to turn off the connection with the mobile terminal, and a functional instruction instructing an earphone to enter a power saving mode.

In addition, an embodiment of the present disclosure provides an earphone 700, comprising:

a detection sensor 701 for detecting putting-on sequential order information or taking-off sequential order information of the first earphone and/or the second earphone;

a processor 702 for determining a first functional instruction corresponding to the putting-on sequential order information or a second functional instruction corresponding to the taking-off sequential order information according to a preset correspondence between the putting-on sequential order information or the taking-off sequential order information output by the detection sensor and functional instructions of a mobile terminal; and a communication device 703 for sending the first functional instruction or the second functional instruction to the mobile terminal, so that the mobile terminal executes the first functional instruction or the second functional instruction to realize the first interaction function or the second interaction function with the earphones.

It should be noted that the operating process of the modules of the earphone in the embodiment of the present disclosure corresponds to the implementation steps in the above embodiments of the interactive control method of earphones. Therefore, for more information about the modules of the earphone, please refer to the description of the above method embodiments, which will not be repeated here.

Figure 8:
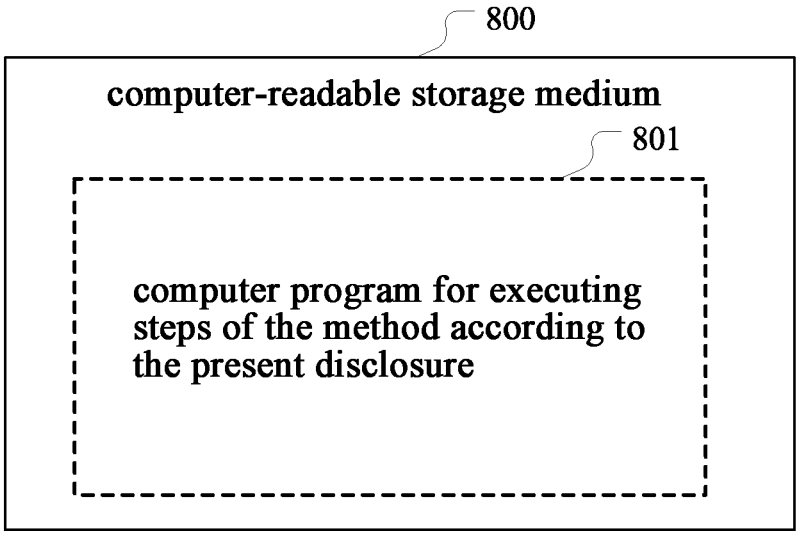
FIG. 8 is a block diagram of a computer storage medium according to an embodiment of the present disclosure.

Still another embodiment of the present disclosure provides a computer-readable storage medium 800. Referring to FIG. 8, the computer-readable storage medium 800 has a computer program (i.e., the computer program 801 for executing steps of the method according to the present disclosure in FIG. 8) stored thereon. When the computer program 801 is executed by a processor, the steps of the above interactive control method of earphones are implemented.

A person skilled in the art should understand that the embodiments of the present disclosure may be provided as a method, a system, or a computer program product. Thus, the present disclosure may take the form of an all-in-hardware embodiment, an all-in-software embodiment, or an embodiment combining software and hardware. Furthermore, the present disclosure may take the form of a computer program product embodied on one or more computer-usable storage media (including, but not limited to, disk storage, CD-ROMs, optical memories, etc.) having computer-usable program code recorded thereon.

The present disclosure is described with reference to flowcharts and/or block diagrams of the method, the device (system), and the computer program product according to the embodiment of the present disclosure. It should be understood that each flow and/or block in the flowcharts and/or block diagrams, and combinations of the flows and/or blocks in the flowcharts and/or block diagrams may be implemented by computer program instructions. The computer program instructions may be provided to a processor of a general purpose computer, a special purpose computer, an embedded processor, or other programmable data processing device to generate a machine so that a device for implementing the functions specified in one or more flows of a flowchart or and/or one or more blocks of a block diagram can be generated by instructions executed by a processor of a computer or other programmable data processing device.

It should be noted that the terms "comprise", "include" or any other variations thereof are non-exclusive or open-ended, so that a process, method, article, or device including a series of elements includes not only those elements listed but also includes unspecified elements as well as elements that are inherent to such a process, method, article, or device. In the case that there is no more limitation, the phrase "comprising a . . . " does not exclude that the process, method, article, or device including the named element includes additional named element.

In the description of the present disclosure, many specific details are illustrated. However, it can be understood that embodiments of the present disclosure may be practiced without these specific details. In some instances, well-known methods, structures and techniques have not been shown in detail in order not to obscure the understanding of this description. Similarly, it should be understood that in order to simplify the disclosure of the present disclosure and help understand one or more of the various inventive aspects, in the above description of exemplary embodiments of the present disclosure, various features of the present disclosure are sometimes grouped together in a single embodiment, diagrams, or description thereof. However, the disclosed method should not be interpreted as reflecting an intention that the claimed present disclosure requires more features than those expressly recited in each claim. More exactly, as the following claims reflect, inventive aspects include features less than all features of a single foregoing disclosed embodiment. Thus, the claims following the detailed description are hereby expressly incorporated into this detailed description, with each claim being an independent embodiment of the present disclosure.

The description above is merely specific embodiments of the present disclosure. With the foregoing teachings of the present disclosure, a person skilled in the art may make other improvements or modifications based on the foregoing embodiments. A person skilled in the art should understand that the specific description above is only for better explaining the present disclosure, and the protection scope of the present disclosure should be subject to the protection scope of the claims.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An interactive control method of earphones, wherein the earphones comprise a first earphone and a second earphone, and the method comprises:

acquiring putting-on sequential order information or taking-off sequential order information of the first earphone and/or the second earphone;

determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and sending the first functional instruction or the second functional instruction to the mobile terminal, so that the mobile terminal executes the first functional instruction or the second functional instruction to realize a first interaction function or a second interaction function with the earphones, wherein acquiring putting-on sequential order information or taking-off sequential order information of the first earphone and/or the second earphone comprises:

acquiring an earphone identifier corresponding to putting-on or taking-off in a process of putting-on or taking-off, and according to the earphone identifier determining the putting-on sequential order information or the taking-off sequential order information of the first earphone, or the putting-on sequential order information or the taking-off sequential order information of the second earphone, or the putting-on sequential order information or the taking-off sequential order information of the first earphone and the second earphone, wherein acquiring putting-on sequential order information of the first earphone and the second earphone comprises:

acquiring a first putting-on switching electrical signal generated by a first detection sensor on the first earphone in response to a current value change after the user puts the first earphone on the first ear; and acquiring a second putting-on switching electrical signal generated by a second detection sensor on the second earphone in response to a current value change after the user puts the second earphone on the second ear;

wherein a resistance value of a built-in resistor of the first detection sensor is different from a resistance value of a built-in resistor of the second detection sensor, and the first putting-on switching electrical signal is acquired before the second putting-on switching electrical signal is acquired.

2. The method according to claim 1, wherein the putting-on sequential order information includes: sequential order information of putting-on switching electrical signals acquired when a user first puts the first earphone on a first ear and then puts the second earphone on a second ear; and the taking-off sequential order information includes: sequential order information of taking-off switching electrical signals acquired when a user first takes the first earphone off a first ear and then takes the second earphone off a second ear.

3. The method according to claim 2, wherein the sequential order information of putting-on switching electrical signals acquired includes: a corresponding putting-on switching electrical signal acquired when the earphone switches from a non-wearing state to a wearing state after the user puts the first earphone on a first ear or puts the second earphone on a second ear;

the sequential order information of taking-off switching electrical signals acquired includes: a corresponding taking-off switching electrical signal acquired when the earphone switches from a wearing state to a non-wearing state after the user takes the first earphone off the first ear or takes the second earphone off the second ear.

4. The method according to claim 1, wherein the first earphone is a left earphone, and the second earphone is a right earphone;

putting-on sequential order information of the left earphone and the right earphone is acquired, and a first functional instruction corresponding to the putting-on sequential order information is determined according to a preset correspondence between the putting-on sequential order information and functional instructions of the mobile terminal;

the first functional instruction includes at least one of the following functional instructions: a functional instruction instructing to establish a connection with the earphones, a functional instruction instructing to run a music application in the mobile terminal, and a functional instruction instructing to display a frequently listened music playlist of the user in the music application and play music through the earphones.

5. The method according to claim 1, wherein the first earphone is a right earphone, and the second earphone is a left earphone;

putting-on sequential order information of the right earphone and the left earphone is acquired, and a first functional instruction corresponding to the putting-on sequential order information is determined according to a preset correspondence between the putting-on sequential order information and functional instructions of the mobile terminal;

the first functional instruction includes at least one of the following functional instructions: a functional instruction instructing the mobile terminal to turn on a call mode, a functional instruction instructing the mobile terminal to display a dial interface to receive a phone number input by a user, or a functional instruction instructing the mobile terminal to answer an incoming call through the earphones.

6. The method according to claim 1, wherein the first earphone is a left earphone, and the second earphone is a right earphone;

taking-off sequential order information of the left earphone and the right earphone is acquired, and a second functional instruction corresponding to the taking-off sequential order information is determined according to a preset correspondence between the taking-off sequential order information and functional instructions of the mobile terminal;

the second functional instruction includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off the connection with the earphones.

7. The method according to claim 1, wherein the first earphone is a right earphone, and the second earphone is a left earphone;

taking-off sequential order information of the right earphone and the left earphone is acquired, and a second functional instruction corresponding to the taking-off sequential order information is determined according to a preset correspondence between the taking-off sequential order information and functional instructions of the mobile terminal;

the second functional instruction includes at least one of the following functional instructions: a functional instruction instructing to play a call voice through a speaker in the mobile terminal, a functional instruction instructing to turn off the connection with the earphones, or a functional instruction instructing the mobile terminal to hang up.

8. The method according to claim 1, wherein acquiring an earphone identifier corresponding to putting-on or taking-off in a process of putting-on or taking-off comprises:

according to first current information of a first current passing through the built-in resistor of the first detection sensor, determining the earphone identifier of the first earphone corresponding to the first current information; and according to second current information of a second current passing through the built-in resistor of the second detection sensor, determining the earphone identifier of the second earphone corresponding to the second current information.

9. The method according to claim 1, wherein the method further comprises:

determining a third functional instruction corresponding to the putting-on sequential order information or a fourth functional instruction corresponding to the taking-off sequential order information according to a preset correspondence between the putting-on sequential order information or the taking-off sequential order information and functional instructions of the earphones; and controlling the earphones to execute the third functional instruction or the fourth functional instruction to realize a third interaction function or a fourth interaction function with the mobile terminal.

10. The method according to claim 9, wherein determining a third functional instruction corresponding to the putting-on sequential order information or a fourth functional instruction corresponding to the taking-off sequential order information according to a preset correspondence between the putting-on sequential order information or the taking-off sequential order information and functional instructions of the earphones comprises:

determining a third functional instruction corresponding to the putting-on sequential order information according to a preset correspondence between the putting-on sequential order information and functional instructions of the earphones;

the third functional instruction includes at least one of the following functional instructions: a functional instruction instructing the earphones to establish a connection with the mobile terminal, a functional instruction instructing the earphones to enter a standby playback mode, and a functional instruction instructing the earphone to play music or answer a call;

or, determining a fourth functional instruction corresponding to the taking-off sequential order information according to a preset correspondence between the taking-off sequential order information and functional instructions of the earphones;

the fourth functional instruction includes at least one of the following functional instructions: a functional instruction instructing the earphones to enter a standby playback mode, a functional instruction instructing the earphones to turn off the connection with the mobile terminal, and a functional instruction instructing the earphones to enter a power saving mode.

11. The method according to claim 1, wherein when the earphone identifier indicates that there is only the putting-on information or the taking-off information of the first earphone, a fifth functional instruction corresponding to the putting-on sequential order information or a sixth functional instruction corresponding to the taking-off sequential order information is determined according to a preset correspondence between the putting-on sequential order information or the taking-off sequential order information and functional instructions of the mobile terminal;

the fifth functional instruction or the sixth functional instruction is sent to the mobile terminal, so that the mobile terminal executes the fifth functional instruction or the sixth functional instruction to realize a fifth interaction function or a sixth interaction function with the earphone.

12. The method according to claim 11, wherein the first earphone is a left earphone;

the fifth functional instruction corresponding to the putting-on information is determined according to a preset correspondence between the putting-on information of the left earphone and functional instructions of the mobile terminal;

the fifth functional instruction includes at least one of the following functional instructions: a functional instruction instructing to establish a connection with the earphone, a functional instruction instructing to run a music application in the mobile terminal, and a functional instruction instructing to display a frequently listened music playlist of the user in the music application and play music through the earphone.

13. The method according to claim 11, wherein the first earphone is a left earphone;

when the earphone identifier indicates that there is only information of the left earphone, the sixth functional instruction corresponding to the taking-off sequential order information is determined according to a preset correspondence between the taking-off sequential order information of the left earphone and the functional instructions of the mobile terminal;

the sixth functional instruction includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off the connection with the earphone.

14. The method according to claim 11, wherein the first earphone is a right earphone;

when the earphone identifier indicates that there is only information of the right earphone, the fifth functional instruction corresponding to the putting-on sequential order information is determined according to a preset correspondence between the putting-on sequential order information of the right earphone and the functional instructions of the mobile terminal;

the fifth functional instruction includes at least one of the following functional instructions: a functional instruction instructing the mobile terminal to turn on a call mode, a functional instruction instructing the mobile terminal to display a dial interface to receive a phone number input by a user, or a functional instruction instructing the mobile terminal to answer an incoming call through the earphone.

15. The method according to claim 11, wherein the first earphone is a right earphone;

when the earphone identifier indicates that there is only information about the right earphone, the sixth functional instruction corresponding to the taking-off sequential order information is determined according to a preset correspondence between the taking-off sequential order information of the right earphone and the functional instructions of the mobile terminal;

the sixth functional instruction includes at least one of the following functional instructions: a functional instruction instructing to play a call voice through a speaker in the mobile terminal, a functional instruction instructing to turn off the connection with the earphone, or a functional instruction instructing the mobile terminal to hang up.

16. An earphone, comprising:

a detection sensor for detecting putting-on sequential order information or taking-off sequential order information of the first earphone and/or the second earphone;

a processor for determining a first functional instruction corresponding to the putting-on sequential order information or a second functional instruction corresponding to the taking-off sequential order information according to a preset correspondence between the putting-on sequential order information or the taking-off sequential order information output by the detection sensor and functional instructions of a mobile terminal; and a communication device for sending the first functional instruction or the second functional instruction to the mobile terminal, so that the mobile terminal executes the first functional instruction or the second functional instruction to realize a first interaction function or a second interaction function with the earphones, wherein acquiring putting-on sequential order information or taking-off sequential order information of the first earphone and/or the second earphone comprises:

acquiring an earphone identifier corresponding to putting-on or taking-off in a process of putting-on or taking-off, and according to the earphone identifier determining the putting-on sequential order information or the taking-off sequential order information of the first earphone, or the putting-on sequential order information or the taking-off sequential order information of the second earphone, or the putting-on sequential order information or the taking-off sequential order information of the first earphone and the second earphone, wherein acquiring putting-on sequential order information of the first earphone and the second earphone comprises:

acquiring a first putting-on switching electrical signal generated by a first detection sensor on the first earphone in response to a current value change after the user puts the first earphone on the first ear; and acquiring a second putting-on switching electrical signal generated by a second detection sensor on the second earphone in response to a current value change after the user puts the second earphone on the second ear;

wherein a resistance value of a built-in resistor of the first detection sensor is different from a resistance value of a built-in resistor of the second detection sensor, and the first putting-on switching electrical signal is acquired before the second putting-on switching electrical signal is acquired.

17. An interactive control method of earphones, wherein the earphones comprise a first earphone and a second earphone, and the method comprises:

acquiring putting-on sequential order information or taking-off sequential order information of the first earphone and/or the second earphone;

determining a first functional instruction corresponding to the putting-on sequential order information or a second functional instruction corresponding to the taking-off sequential order information according to a preset correspondence between the putting-on sequential order information or the taking-off sequential order information and functional instructions of a mobile terminal; and sending the first functional instruction or the second functional instruction to the mobile terminal, so that the mobile terminal executes the first functional instruction or the second functional instruction to realize a first interaction function or a second interaction function with the earphones, wherein acquiring putting-on sequential order information or taking-off sequential order information of the first earphone and/or the second earphone comprises:

acquiring an earphone identifier corresponding to putting-on or taking-off in a process of putting-on or taking-off, and according to the earphone identifier determining the putting-on sequential order information or the taking-off sequential order information of the first earphone, or the putting-on sequential order information or the taking-off sequential order information of the second earphone, or the putting-on sequential order information or the taking-off sequential order information of the first earphone and the second earphone, wherein acquiring taking-off sequential order information of the first earphone and the second earphone comprises:

acquiring a first taking-off switching electrical signal generated by a first detection sensor on the first earphone in response to a current value change after the user takes the first earphone off the first ear; and acquiring a second taking-off switching electrical signal generated by a second detection sensor on the second earphone in response to a current value change after the user takes the second earphone off the second ear;

wherein a resistance value of a built-in resistor of the first detection sensor is different from a resistance value of a built-in resistor of the second detection sensor, and the first taking-off switching electrical signal is acquired before the second taking-off switching electrical signal is acquired.

* * * * *